United States Patent [19]

Fuller et al.

[11] 4,336,888

[45] Jun. 29, 1982

[54] HOLDER FOR STIFFLY FLEXIBLE SHEETS

[76] Inventors: Robert T. Fuller, 1351 Empire St., Anaheim, Calif. 92804; Robert J. Sanders, 2200 E. Oskosh Cir., Anaheim, Calif. 92806

[21] Appl. No.: 49,591

[22] Filed: Jun. 18, 1979

[51] Int. Cl.[3] ..... A47F 7/16

[52] U.S. Cl. ..... 211/45; 211/50; 211/181

[58] Field of Search ..... 211/50, 55, 45, 490, 211/134, 181, 106; 248/441 D, 473

[56] References Cited

U.S. PATENT DOCUMENTS

| | | | |
|---|---|---|---|
| 1,501,087 | 7/1924 | Anderson | 211/181 X |
| 2,317,867 | 4/1943 | Taylor et al. | 248/441 D |
| 3,243,047 | 3/1966 | Witteborg | 211/88 |
| 4,119,207 | 10/1978 | Fuller et al. | 211/45 |

*Primary Examiner*—Roy D. Frazier
*Assistant Examiner*—Robert W. Gibson, Jr.
*Attorney, Agent, or Firm*—Donald D. Mon

[57] ABSTRACT

A holder for stiffly flexible sheets such as flooring samples which are likely to curl at their edges and corners. The holder has a proximal edge, a distal edge, and two side edges connecting the proximal and distal edges. The edges form a top central opening through which a sheet in the holder can be seen. Each of the four edges has a top rail to restrain the sheet from upward movement. The proximal edge has a bottom restraint and an edge restraint to restrain the sheet at that edge. A bottom support extends across the area bounded by the edges to give underlying support to the sheet. The top rail at the distal edge is shaped concavely to form a deflector to deflect the leading edge of a sheet inserted into the holder. Mounting pins can be provided for mounting the holder to a stand. The deflector deflects the leading edge of the sheet which it confronts into a channel. Mounting pins can be provided for mounting the holder to the stand.

14 Claims, 7 Drawing Figures

FIG. 1
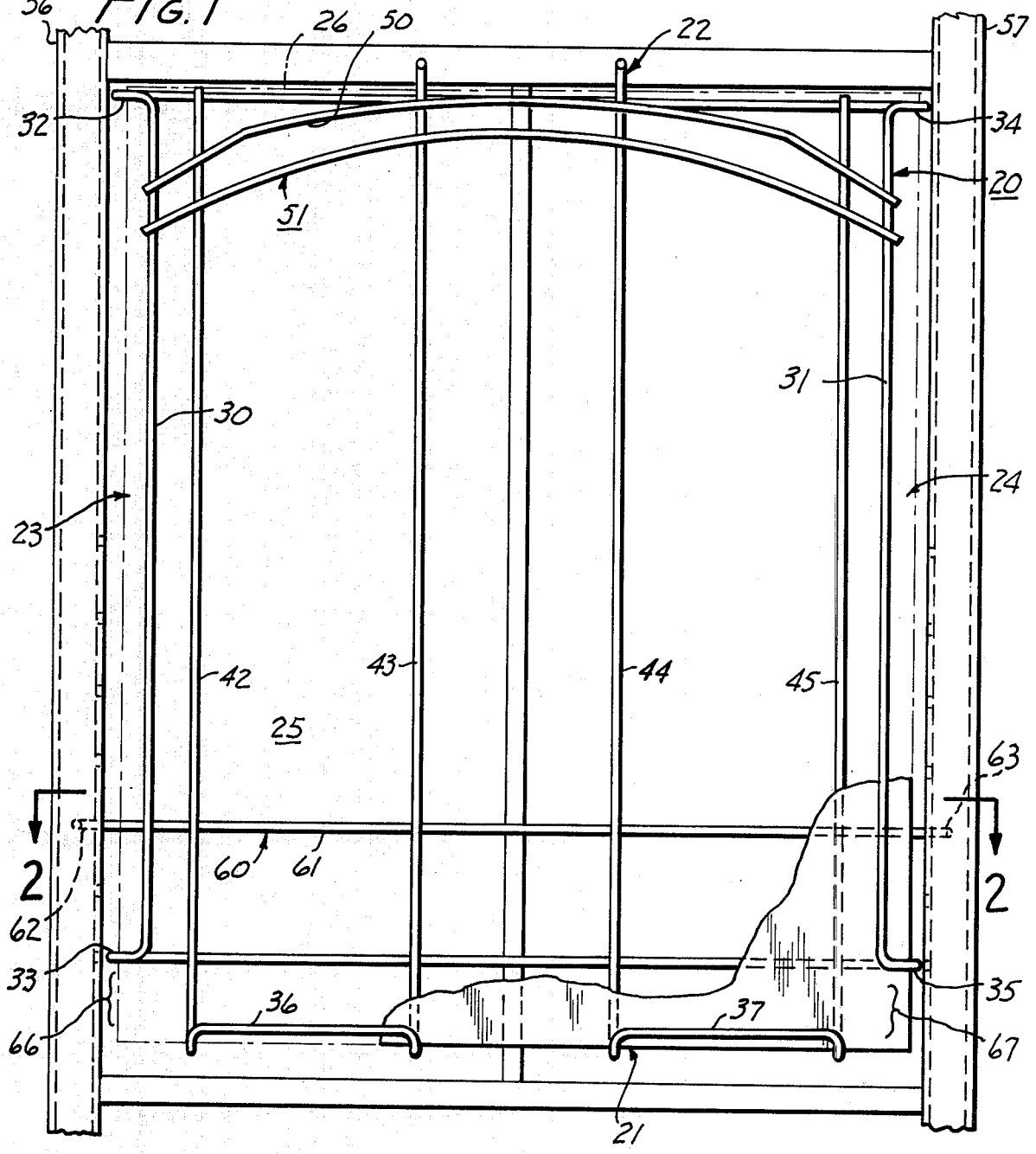
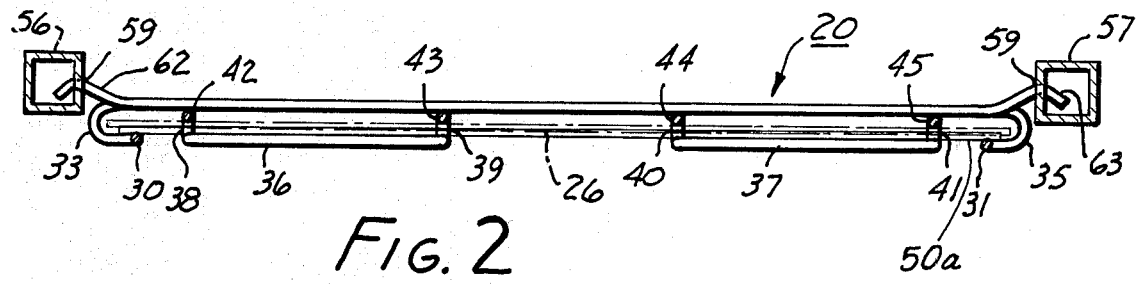
FIG. 2

HOLDER FOR STIFFLY FLEXIBLE SHEETS

FIELD OF THE INVENTION

This invention relates to a holder for holding stiffly flexible sheets such as samples of vinyl resilient flooring that are likely to curl at their edges and corners.

BACKGROUND OF THE INVENTION

Sellers of flooring samples have the problem of displaying them in suitable quantities while using minimum floor space. Some solutions to this problem are found in Fuller and Sanders Pat. Nos. 4,063,648 and 4,119,207 issued Dec. 20, 1977 and Oct. 10, 1978 respectively. In displays shown in these patents, display holders are provided for holding the samples in a shingled display. These are essentially suitable for displaying carpet samples which tend to remain sensibly flat. They are also useful for the more stiffly flexible sheets such as linoleum and the like, but the less stiff materials such as vinyl resilient flooring have a tendency to curl at their edges and corners as a consequence of change of temperature. Accordingly, it becomes necessay to hold them down. If they are to be held at their edges, it becomes necessary to get them into some kind of a holder and this can be a problem if they are already curled at their edges and at their corners. Accordingly, a merchant can have considerable difficulty in handling and maintaining a large quantity of flooring samples in a neat and sensibly manipulable display.

Because it is desirable that these be readily removable to demonstrate them to the customer, the problem is even more severe, because repetitive insertion will be required.

It is an object of this invention to provide a holder for such sheets into which the sheet can readily be inserted, and from which it can readily be removed. The holder is adapted to being mounted in a wide variety of stand configurations, and to adapt any stand configuration to hold a surprisingly large number of such sheets, with ready accessibility and considerable visibility.

A holder according to this invention has four edges, a proximal edge, a distal edge, and two side edges connecting them to form an upper opening through which the sample can be viewed. There are four top rails at the edges. The distal rail is formed as a concave deflector to deflect beneath it the leading end of a sample being inserted. The proximal edge has a bottom restraint and an edge restraint to hold the distal end of the sample from slipping past it. Bottom support means supports the sheet from below, in the holder.

According to a preferred but optional feature of the invention, mounting pins can be provided for mounting the holder to a stand, and especially one in which the mounting pins can be manipulated so that the frame is readily attached to and detached from the stand.

The above and other features of this invention will be fully understood from the following detailed description and the accompanying drawings in which:

FIG. 1 is a plan view of the presently-preferred embodiment of the invention;

FIG. 2 is a cross-section taken at line 2—2 in FIG. 1;

Figure 6:
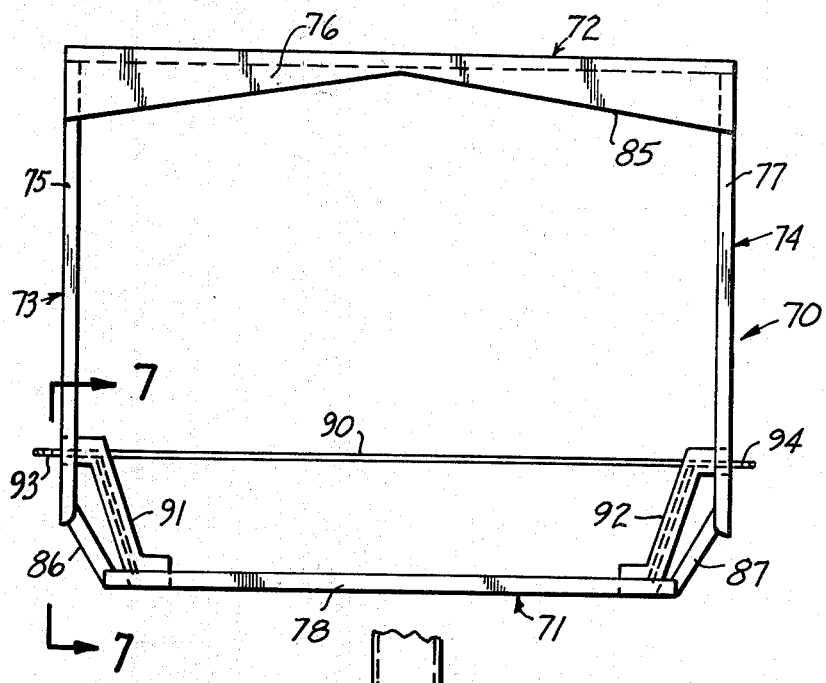
FIG. 6 is a plan view in another embodiment of the invention.

In FIG. 1 there is shown a holder 20 according to the invention. This embodiment can be constructed from wire or rod which is bent to the desired shape and spot welded at the intersections. It is generally similar to the holder shown in said Fuller and Sanders U.S. Pat. No. 4,119,207, but with additions respective to this invention. The holder has a proximal edge 21, a distal edge 22, and a pair of side edges 23, 24 which connect the proximal and distal edges. This leaves an opening 25 through which a sheet 26 of sample material can be viewed.

The holder has a top face facing toward the viewer in FIG. 1, and a bottom face which faces the other direction. Top rails 30, 31 are formed at side edges 23 and 24. They are conveniently formed by the bends as shown. There are U-shaped bends 32, 33 at edge 23 and bends 34, 35 at edge 24 which can provide side restraints when desired. Side restraints are not necessary, because an adjacent stand member can provide the function, and in some constructions where the bend is not an inherent part of the device, may not be provided at all.

Top rails 36, 37 are formed at the proximal edge which are formed by the bends shown, including U-shaped bends 38, 39, 40, 41 which form edge restraints at the proximal edge which impede movement of the sheet in the proximal direction. Similarly, bottom supports 42, 43, 44, 45 are formed as a part of the continuous piece of wire which extends along the bottom face of the holder so as to provide underlying support for the sheet. Adjacent to bends 38, 39, 40 and 41, they in addition constitute bottom restraints at the proximal edge. Two of these supports terminate in up-turned fingers 46, 47. These are optional and can serve as edge restraints at the distal edge to limit the movement of the sheet past the distal edge.

The top rail 50 at its distal edge is formed as a concave deflector 51. The concave shape will assure that the leading edge of a curled sheet will gradually be deflected beneath the top rail 50 as it slides along beneath the two side top rails.

The spot welding to hold this assembly together will be evident from an examination of the drawings. Because bottom support given by the wires may be insufficient, a sheet of cardboard 50*a* can optionally be inserted to form a more complete bottom support. Its thickness will be such that the sheet will still be admitted by the structure.

Figure 5:
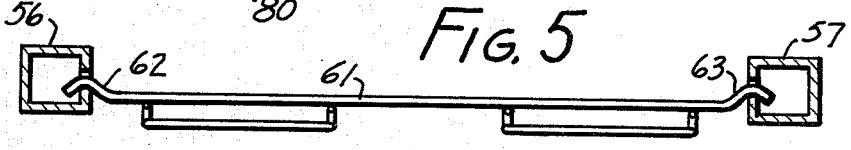
FIGS. 4 and 5 are fragmentary views showing the mode of mounting the holders to the stand.
Figure 4:
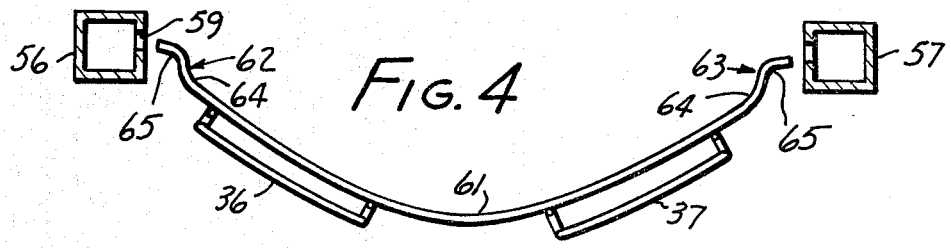

This holder is adapted to be attached to a stand 55. The stand has a pair of uprights 56, 57 and if desired a rear upright 58. Uprights 56 and 57 have drilled holes 59 which are intended to receive mounting pins that will now be described. A mounting member 60 comprises a wire 61 which is spot-welded at its intersections with the bottom supports and extends beyond the side edges for insertion into the hole. The pins 62 and 63 are the same ones shown in Fuller and Saunders U.S. Pat. No. 4,119,207, which is incorporated herein by reference in its entirety. The purpose of this construction is shown in FIGS. 4 and 5 where the pins are shown as having two bends 64, 65 so that when the holder is bent as shown in FIG. 4 they can be inserted into holes 59. Then when the holder returns by its own resilience to its flat condition, the pins are hooked into the holes and are very difficult to remove except by reversal of the same action as enabled them to be inserted in the first place.

The frame is also provided with a pair of access gaps 66, 67 in the two side edges so that the sheet can be slipped beneath the two top rails, moved beyond the proximal top rail, and then pulled back beneath the proximal top rail.

FIG. 6 shows another embodiment of holder 70 which is primarily made from sheet metal instead of from spot-welded wire or rod. As used herein, the term "wire" and "rod" are used interchangeably.

Holder 20 of FIG. 1 illustrates that the four edges need not be bounded by channels, but need include only certain kinds of restraint at the tops of the edges and at the bottom of one. FIG. 6 illustrates that the device can be more in the nature of a frame with channels on all sides, thereby illustrating the generality of the invention.

Figure 7:
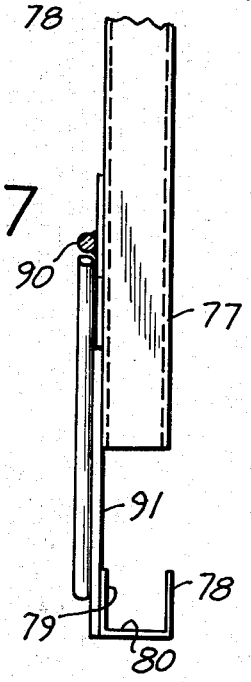
FIG. 7 is a fragmentary side view taken at line 7—7 in FIG. 6.

In FIG. 6 holder 70 has a proximal edge 71, a distal edge 72, and two side edges 73, 74 interconnecting the proximal and distal edges. All of the edges are formed as channels. They respectively have top rails 75, 76, 77, 78 and corresponding bottom rails and edge rails. FIG. 7 shows bottom rail 79 acting as a bottom restraint and edge rail 80 of the proximal edge. The other sides have similar constructions and functions. However, the distal edge of top rail 76 is formed as a concave deflector 85 for the same purpose as concave deflector 51 in FIG. 1. Access gaps 86, 87 are formed at the two proximal corners. Mounting member 90 is spot-welded to flexible mounting plates 91, 92 which are flexible relative to the frame, and may if desired be attached only to the proximal edge. This is for improving the flexibility of the rod structure which forms the mounting member. Pins 93, 94 are included which project beyond the side edges with the same double curvature as in the embodiment of FIG. 1. This holder is relatively stiff and not readily flexed. For this reason the mounting member is rod-like and stiffly flexible, and can be flexed independently of the frame portion of the holder to provide for insertion by the use of the technique shown in FIGS. 4 and 5, with only the rod flexing.

The channels themselves can provide adequate bottom support. However, it may be useful to place a sheet of cardboard inside the holder to provide a more complete bottom support for the sheet to be displayed, which will then be inserted above it.

Figure 3:
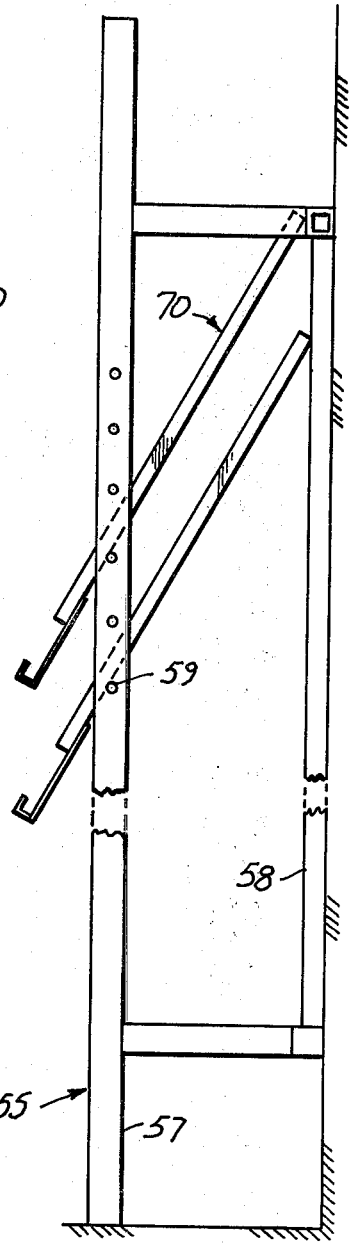
FIG. 3 is a side view of a stand with holders as shown in FIG. 1 mounted thereto.

FIG. 3 shows the embodiment of FIG. 6 in the stand but it will be understood from FIGS. 4 and 5 that the same structure works well for holding the embodiment of FIGS. 1 and 2.

The use of the holders should be evident from the foregoing. The distal edge of the sheet is inserted through the access gaps and slid along the side members which guide the edges while restraining them against movement. When the sheet reaches the concave deflector, the deflector will deflect the leading edge beneath the top rail, and the top rail will hold it down. The sheet will be somewhat shorter than the distance between the proximal edge member and whatever restraint is at the distal edge so that it can pass the top rail at the proximal edge, and be slid back beneath it, there to be restrained until it is to be removed.

It is not necessary to remove the holder from the stand in order to remove the sample, provided the access gap can be reached. All that is necessary is to slide the sheet forwardly, grasp its lower edge and pull it out through the access gap.

This invention is also adaptable to being placed in a common map holder stand, and can be turned like a page in a book, by providing mounting pins at the top and bottom. These can be placed into holes in the stand. It is also possible to make this device double faced, by providing a deflector and access gaps on both sides and perhaps even at both ends.

The term "concave" as used in connection with the deflector, means an edge that progresses inwardly toward the centerline as it progresses toward the distal edge. It can be V-shaped, U-shaped, or arcuate as preferred.

This invention thereby provides a convenient easily useable device which can economically be manufactured.

This invention is not to be limited by the embodiments shown in the drawings and described in the description which are given by way of example and not of limitation, but only in accordance with the scope of the appended claims.

We claim:

1. A holder for sheets likely to curl at their edges and corners, said holder having a proximal edge, a distal edge, and two side edges joining said proximal and distal edges, an opening being formed within said edges a top rail at each edge to restrain upward movement of the sheet, a bottom restraint and an edge restraint at the proximal edge, bottom support means for the sheet beneath said opening, a deflector extending from one of said two side edges to the other and having a pilot edge which faces concavely toward said proximal edge above and spaced from said bottom restraint, said deflector progressively engaging the distal end of the sheet when it is pushed past it toward said distal edge of said holder, whereby to guide it beneath said top rail at the distal edge, and a gap adjacent to the junction of said proximal edge and each of said side edges to provide the sheet with access to beneath the top rails at each side edge for insertion of said sheet.

2. A holder according to claim 1 in which mounting means is attached to said holder, said mounting means comprising pins projecting beyond opposite edges of said holder.

3. A holder according to claim 2 in which said pins have a pair of curves for retention in respective holes in a stand.

4. A holder according to claim 1 in which said bottom support includes a sheet-like member inserted in said holder.

5. A holder according to claim 1 in which said top rails are formed as portions of folded constructions.

6. A holder according to claim 5 in which said side edge and proximal top rails are comprised of lengths of wire which are joined to edge supports comprising U-shaped bends.

7. A holder according to claim 6 in which edge restraint means is provided at the distal edge.

8. A holder according to claim 1 in which said concave deflector comprises a bent wire.

9. A holder according to claim 1 in which each of said top rails is formed as part of a U-shaped channel, the opposite wall of said channel comprising a bottom restraint.

10. A holder for sheets likely to curl at their edges and corners, comprising: four edge members, each having a channel to receive a respective edge of the sheet, said channels being parallel in pairs, said edge members forming a central opening, there being an access gap in a pair of opposite edge members, and a deflector member bounding one side of said opening and extending from one of said two edge members having a said gap to the other said edge member having a gap, which deflector member faces concavely toward a different one of said edges, with the opening between them, progressively to engage an edge of the sheet when it is pushed past it, whereby to guide the sheet into a channel.

11. A holder according to claim 10 in which mounting means is attached to said holder, said mounting means comprising a pair of pins extending beyond each member of a pair of opposite side members.

12. A holder according to claim 11 in which a flexible member is mounted to each of said last-named opposite side members, and said pins are attached to a respective one of said flexible members.

13. A holder according to claim 12 in which said pins comprise the ends of a single piece of wire, said wire being attached to said flexible member.

14. A holder according to claim 10 in which a sheet-like member is inserted in said holder to support the bottom of said sheet.

* * * * *